US008287041B2

(12) United States Patent
Paulin

(10) Patent No.: US 8,287,041 B2
(45) Date of Patent: Oct. 16, 2012

(54) DISPOSABLE CHAIR COVERS

(76) Inventor: Victoria Paulin, Boynton Beach, FL (US)

( * ) Notice: Subject to any disclaimer, the term of this patent is extended or adjusted under 35 U.S.C. 154(b) by 0 days.

(21) Appl. No.: 13/214,005

(22) Filed: Aug. 19, 2011

(65) Prior Publication Data

US 2012/0074745 A1 Mar. 29, 2012

Related U.S. Application Data

(63) Continuation-in-part of application No. 11/208,168, filed on Aug. 19, 2005, which is a continuation-in-part of application No. 11/104,006, filed on Apr. 12, 2005, now Pat. No. 7,469,962, which is a continuation-in-part of application No. 10/816,530, filed on Apr. 1, 2004, now abandoned, which is a continuation-in-part of application No. 11/104,006, filed on Apr. 12, 2005, now Pat. No. 7,469,962.

(51) Int. Cl.
*A47C 31/11* (2006.01)

(52) U.S. Cl. ..... 297/228.1; 297/229

(58) Field of Classification Search ..... 297/219.1, 297/228.1, 229, 225, 228, 440.11
See application file for complete search history.

(56) References Cited

U.S. PATENT DOCUMENTS

| | | | | |
|---|---|---|---|---|
| 1,820,104 | A * | 8/1931 | Whaley | 297/224 |
| 2,349,193 | A | 5/1944 | Pass | |
| 3,371,957 | A | 3/1968 | Cook | |
| 4,096,309 | A * | 6/1978 | Stillman | 442/382 |
| 4,676,376 | A | 6/1987 | Keiswetter | |
| 4,693,511 | A | 9/1987 | Seltzer et al. | |
| 4,697,847 | A | 10/1987 | Herschiag | |
| D321,805 | S | 11/1991 | Piciullo | |
| 5,121,938 | A | 6/1992 | Gross et al. | |
| 5,506,019 | A | 4/1996 | Abeyta et al. | |
| 5,540,480 | A | 7/1996 | Christa | |
| 5,690,380 | A | 11/1997 | Waters | |
| D416,430 | S | 11/1999 | DiGenova | |
| 6,001,460 | A | 12/1999 | Morman et al. | |
| D419,025 | S | 1/2000 | Lindberg | |
| 6,048,026 | A * | 4/2000 | Barnett et al. | 297/229 |
| 6,079,778 | A | 6/2000 | Lindberg | |
| 6,096,668 | A | 8/2000 | Abuto et al. | |
| 6,207,237 | B1 | 3/2001 | Haffner | |

(Continued)

FOREIGN PATENT DOCUMENTS

DE 4217613 A1 2/1993

(Continued)

OTHER PUBLICATIONS

International Search Report and Written Opinion dated Jan. 22, 2008 issued by the United States Patent and Trademark Office as International Searching Authority in connection with International Application No. PCT/US2006/13104 (6 pages).

*Primary Examiner* — Sarah B McPartlin
(74) *Attorney, Agent, or Firm* — Kevin P. Crosby; GrayRobinson, P.A.

(57) ABSTRACT

A folding chair cover comprised of first and second sheets of non-woven fabric attached together along strategically sized and shaped respective edges thereof. The non-woven sheets are cut from bolts of non-woven fabric in such a manner as to effectively use the least amount of non-woven material in the creation of the covers.

14 Claims, 17 Drawing Sheets

U.S. PATENT DOCUMENTS

| | | | | |
|---|---|---|---|---|
| D448,231 | S * | 9/2001 | Coblentz | D6/611 |
| 6,309,017 | B1 | 10/2001 | Middleton | |
| 6,354,661 | B1 | 3/2002 | Moss | |
| 6,428,098 | B1 | 8/2002 | Allbaugh | |
| 6,447,059 | B1 | 9/2002 | Jackson et al. | |
| D465,688 | S | 11/2002 | Hetherington | |
| D469,999 | S | 2/2003 | Christoffersen | |
| 6,532,595 | B1 | 3/2003 | Holmes | |
| 6,634,709 | B1 * | 10/2003 | Hetherington | 297/229 |
| 6,655,734 | B2 | 12/2003 | Hunter et al. | |
| 6,796,609 | B2 | 9/2004 | Illulian | |
| 6,929,326 | B2 | 8/2005 | Cohen-Fyffe | |
| 7,011,365 | B2 | 3/2006 | Kerfoot et al. | |
| 7,011,367 | B2 | 3/2006 | Riley | |
| 7,469,962 | B2 | 12/2008 | Paulin | |
| 7,600,813 | B2 | 10/2009 | Lanham et al. | |
| 2002/0172797 | A1 | 11/2002 | Sugawara | |
| 2003/0227200 | A1 | 12/2003 | Lopez | |
| 2004/0130193 | A1 | 7/2004 | Haller | |
| 2004/0238087 | A1 | 12/2004 | Ciapessoni | |
| 2004/0262964 | A1 | 12/2004 | Ryan | |
| 2005/0013967 | A1 | 1/2005 | Saccomandi | |
| 2005/0053644 | A1 | 3/2005 | Salemi et al. | |
| 2005/0076981 | A1 | 4/2005 | Koropitzer et al. | |

FOREIGN PATENT DOCUMENTS

| | | | |
|---|---|---|---|
| GB | 2160475 | A | 12/1985 |
| GB | 20322668 | A | 5/1990 |
| WO | 2006110560 | A2 | 10/2006 |

* cited by examiner

DISPOSABLE CHAIR COVERS

CROSS REFERENCE TO RELATED APPLICATIONS

This application is a continuation-in-part of co-pending U.S. application Ser. No. 11/208,168, filed on Aug. 19, 2005, which is a continuation-in-part of U.S. application Ser. No. 11/104,006 filed on Apr. 12, 2005 now U.S. Pat. No. 7,469,962, which is a continuation-in-part of U.S. application Ser. No. 10/816,530 filed on Apr. 1, 2004, now abandoned, which is a continuation-in-part of U.S. application Ser. No. 11/104,006 filed on Apr. 12, 2005, now U.S. Pat. No. 7,469,962.

BACKGROUND OF THE INVENTION

1. Field of the Invention

This invention relates to the field of furniture coverings and, more particularly, pertains to sanitary and decorative table and chair covers, and kits containing the same.

2. Description of the Background Art

Table and chair covers are often used to cover tables and chairs to protect them from dust, dirt, spills and the like. Also, it is common to cover tables and chairs with a cover that improves the aesthetic appearance of the table and chair. Table and chair covers are widely used in the hospitality industry such as at banquets, entertainment and special events. Table and chair covers are commonly constructed of cloth fabric material which can be removed and laundered. The expense in providing the cloth table and chair covers initially, and of transporting, laundering and storing such covers, has created a prohibitively expensive pricing for such covers such that many who would prefer to use covers at their special events do not. As a result, a significant demand goes unmet in the industry.

Nevertheless, the use of covers for tables and chairs is highly desirable, as tables and chairs which are used by a great many people become worn and unsanitary as time passes. Therefore, there is a need to employ table and seat coverings which do not suffer from the economic limitations referenced above.

The need exists, therefore, to provide affordable table and chair covers to limit users' contact with tables and chairs, to reduce wear and tear and the spread of germs and disease that may result from contact with the contaminated surfaces of the tables and chairs.

The need also exists to provide an inexpensive way to alter the appearance of furniture.

It is, therefore, a primary object of my invention to provide sanitary covers for banquet and/or folding tables and chairs and the like, which is made from an inexpensive, single-use material.

It is also an object of this invention to provide such covers which eliminate the need and expense of cleaning the tables and chairs due to the fact that the covers provide a barrier to the transmission of contaminants between the table and seat and the users.

It is a further object of my invention to provide a cover that may be easily replaced each time the table or chair is used for a different event.

Applicant's work in the catering field led to the further development of a catering kit and supplies, which include table covers and table skirts, made of the same non-woven material as the chair covers she invented. Similar to the issue encountered with the chair covers, the expense of purchasing cloth table covers and table skirts, initially, and of transporting, laundering and storing same has created a prohibitively expensive pricing such that many caterers who continue to use cloth table covers and skirts charge the function sponsor for their use, adding significantly (and in many cases, prohibitively) to the cost of an event. Due to this problem, an industry of suppliers and cleaners of just these products has arisen. In other words, the expense and effort required for individual caterers to maintain their own table linens is not justifiable and rental suppliers of these products have emerged.

There are many examples of plastic table covers in the prior art. U.S. Pat. App. Pub. 2004/0238087 to Ciapessoni teaches a disposable tablecloth that can be converted into a trash bag. No criticality of material is discussed by Ciapessoni and no disclosure of non-woven material is made. U.S. Pat. App. Pub. 2003/0031826 to Cleveland et al. teaches a laminated, waterproof table covering for outdoor use. Cleveland's table cover is disclosed to be preferably made of polyethylene laminate and is not disposable.

Although maintenance of plastic table covers is less expensive than the maintenance of cloth table covers, there are still many detriments to the use of plastic. For example, everyone is familiar with the "sticky feel" associated with plastic table covers. If a plastic cover is made of a lightweight material, it may not stay on the table or may cause other lightweight items located thereupon to spill. If the plastic cover is of heavy gauge material, it very often does not conform to the shape of the table. If used on a buffet, a heavy gauge plastic table cover may be caught or pulled by event attendees, resulting in spillage or the like. Many of the lightweight or heavy gauge plastic covers are not disposable, requiring caterers to lug them around. To date, no one has employed non-woven material in connection with table covers and/or skirts.

SUMMARY OF THE INVENTION

To address these and other needs, the present invention is provided in the form of disposable sanitary table and seat covers fabricated from inexpensive, non-woven, disposable fabric readily adapted for a wide variety of tables and chairs, such as, for example but not by way of limitation, banquet tables, round tables, folding tables, banquet chairs and/or folding chairs.

The present invention also provides methods for adjusting the dimensions and contours of the pre-manufactured covers of this invention so that the covers fit over the tables and chairs snugly and neatly.

The covers are made of a non-woven fabric which is inexpensive and may, therefore, be discarded after use.

Caterers encounter a wide variety of table sizes and shapes. Therefore, the non-woven table covers and skirts of this invention, which may be offered in the form of a table-covering kit and include clips and other fastening structures for releasably affixing the cover and/or skirt to a table, provide one or more sheets of non-woven material, which optionally may be adjustable to a wide variety of table shapes and sizes by dashed or solid lines defining the terminal edges of a particular size cover or, alternatively, perforations or other easily-removable connection along which excess material may be removed. For example, the covers and skirts of the present invention may be made available for round, oblong, square, rectangular, or any shaped tables. Each kit may include one or more large sheets that either are pre-manufactured in a specific common table size or can be cut or torn along perforations to create a sheet of a smaller size, if necessary. Preferably, the printed pattern outlines, if used, are only visible on one side of the material, so that they are not visible to the guests. In an alternate embodiment, the table cover and skirt may not employ the aforementioned adjustability features.

Most caterers employ a drape or skirt ("skirt") along the edge of the catering table for cosmetic and safety reasons. Such skirts conceal the space below the table, providing a desirable visual effect. The catering kit of the present invention includes one or more sheets that can be used as a skirt. Once again, the sheet can include printed lines or markings, perforations or other easily-removable connections so that the height of the skirt can be adjusted to fit the table, and, preferably, if printed markings are used, they are only visible on one side of the fabric.

The kit of the present invention includes one or more clips to secure a first sheet, the table cover, to the top of the table and to secure the second sheet, the skirt, along the edge of the table to cover the space below the table top. Once again, the kit can be prepared with certain tables in mind, such as banquet tables, polyethylene tables made by Lifetime Products, Inc., or even adjustable clips for tables of non-standard thickness.

DETAILED DESCRIPTION

Figure 1:
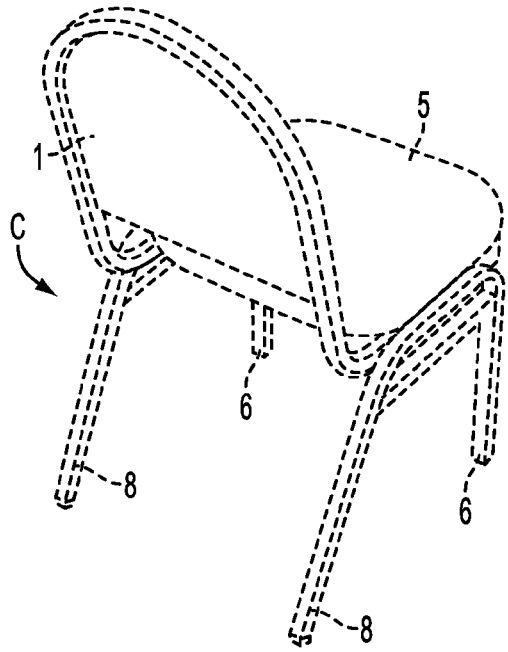
FIG. 1 shows a typical prior art banquet chair which a first embodiment of the cover of the instant invention is meant to partially encapsulate.

Referring now to the drawings, FIG. 1 shows a conventional banquet-type chair denoted by the letter "C" of the type commonly used at social functions such as weddings, birthday parties, concerts, etc. The type of chair shown here is merely to provide an example of one type of chair in connection with which the instant invention can be used. Any other chair, whether of the foldable or non-foldable variety, which is adaptable to receive a non-woven, disposable chair cover, is contemplated to be within the field of use of the instant invention.

Figure 2:
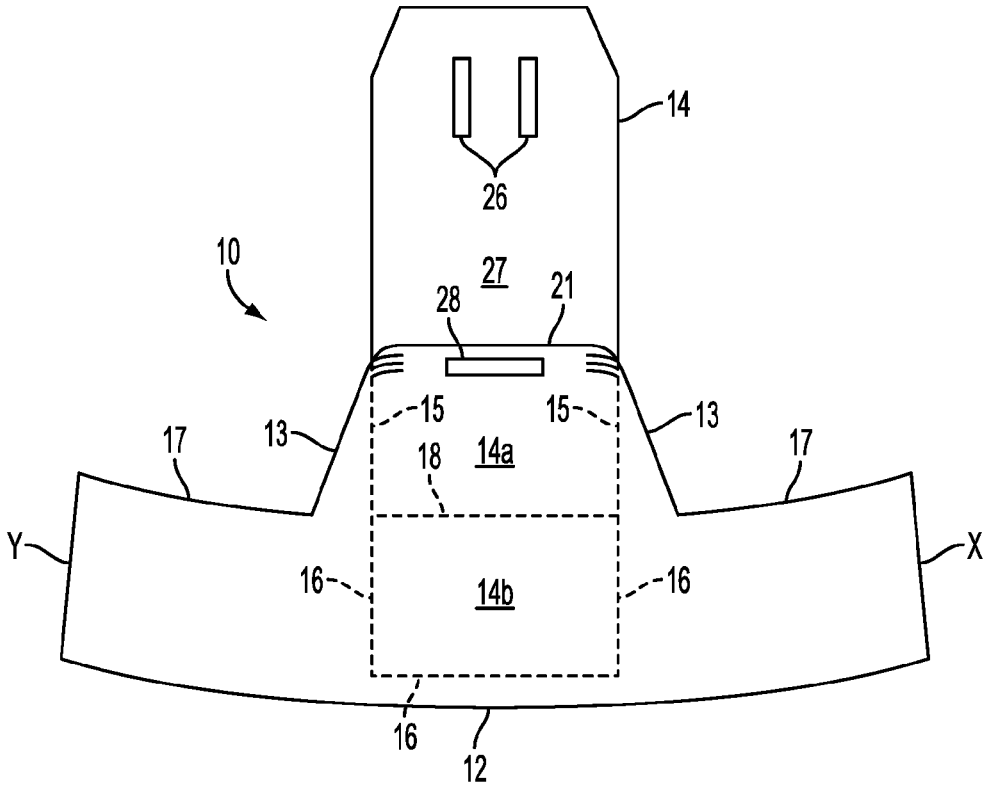
FIG. 2 is a plan view of two sections of non-woven fabric which are adapted to be sewn together or otherwise attached to form the first embodiment of the instant invention.

FIG. 2 shows a typical pattern layout for a first embodiment of the non-woven fabric chair cover of the instant invention prior to the fabric being sewn or otherwise attached together to form a form-fitting chair cover 10. It will be appreciated that the shape of the fabric patterns will vary depending upon the particular chair to be covered. The material may be formed of two panels 12, 14 which are to be sewn together in such a way as to form the cover shown in FIGS. 3 through 9. Sub-panel 12 attaches to sub-panel 14 as shown in FIG. 2 by connecting edges 13 of sub-panel 12 to edges 15 of sub-panel 14. Also, sub-panel 14 is folded along line 18 so that the shape of sub-panel 14 corresponds substantially with the shape of banquet chair C (that is, the upper portion 14' of sub-panel 14 lies partially in registry with seat back 1, and the lower part 14" of sub-panel 14, which is bounded by edges 16 and fold line 18, lies substantially in registry with seat bottom 5). Edges 17 are connected to edges 16, and edges X,Y may or may not be connected together, to form the entirety of the chair cover shown in FIGS. 3-9. Top edge 21 of sub-panel 12 is not, in the preferred embodiment, connected to sub-panel 14, although it may be if desired, such that rear flap 27 would be unnecessary. The panels 12, 14 may be attached through sewing/stitching, ultrasonic welding, adhesive, hook and loop fastener, snaps, buttons, or any other suitable connection structure. The cover 10, as seen in FIGS. 3 through 9, forms generally an upper pocket 20 adapted to at least partially envelope seat back section 4, as well as a lower pocket 22 adapted to envelope seat portion 5 and front and rear legs 6, 8 of chair "C". In this way, a user of the chair will not through ordinary use be able to come into contact with chair "C" while cover 10 is in place.

Figure 3:
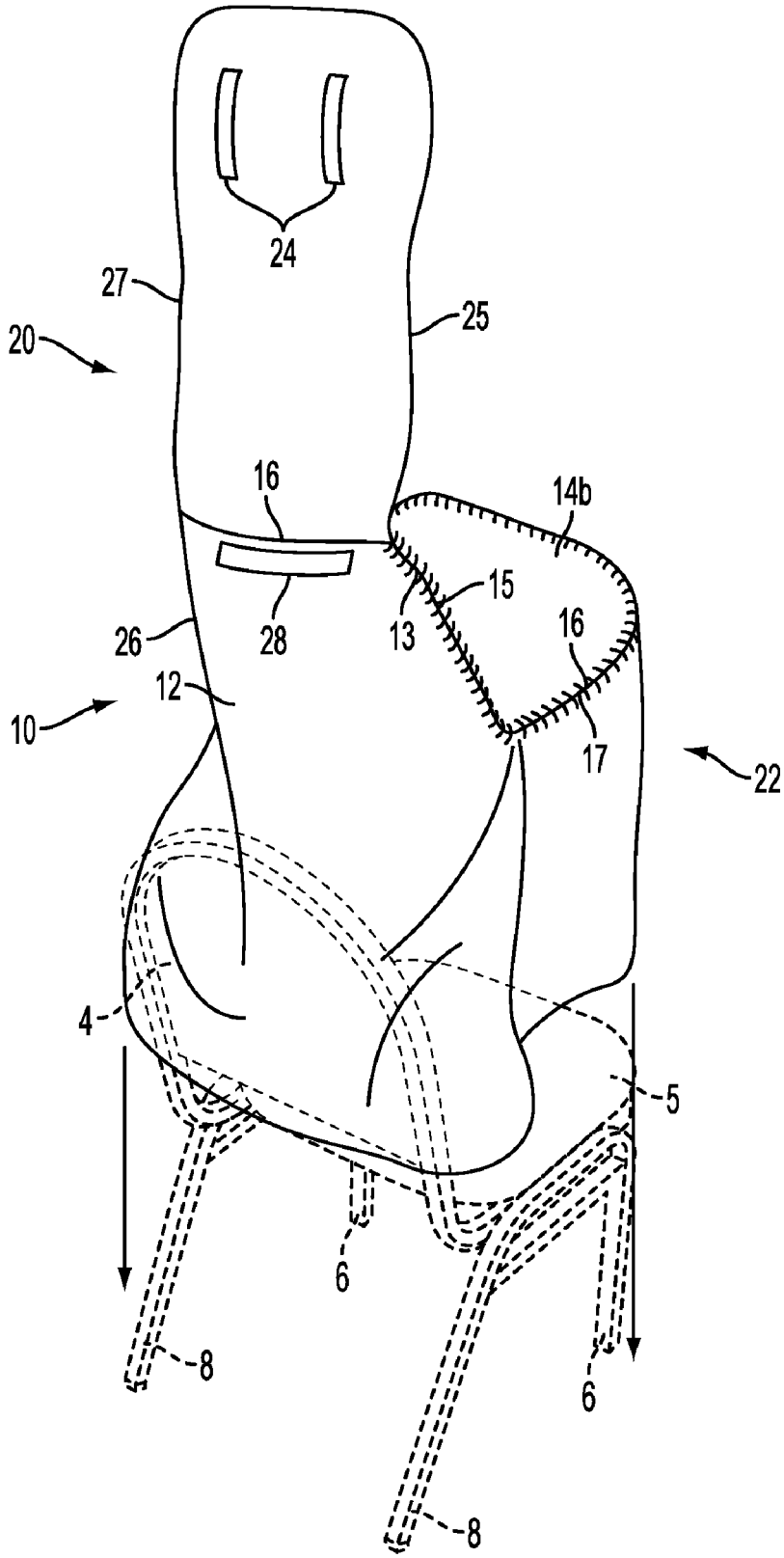
FIGS. 3 through 5 are rear perspective views showing an assembled chair cover of the first embodiment of instant invention being placed about a chair.
Figure 4:
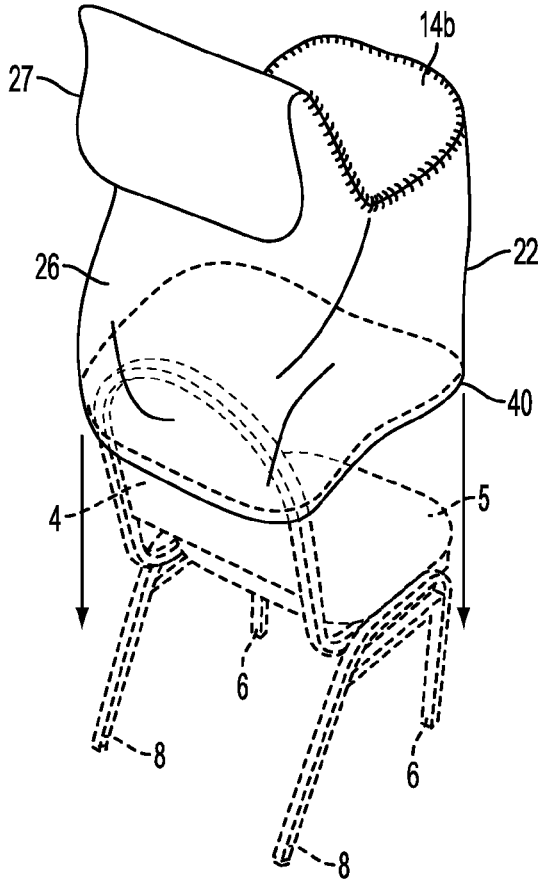
Figure 5:
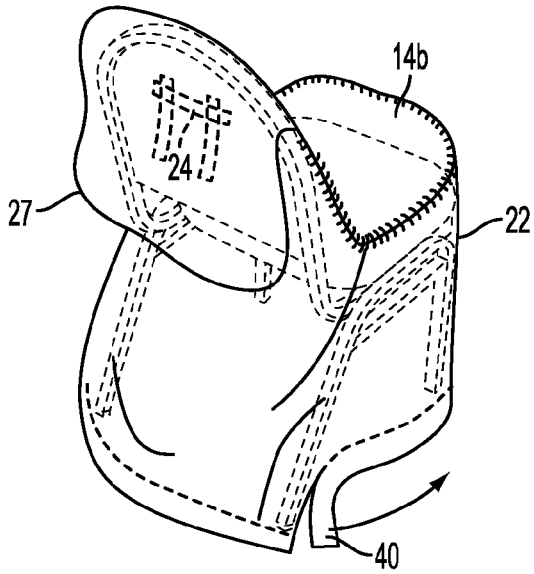

FIGS. 3 through 5 show the chair cover after being assembled.

An additional feature may (but need not necessarily) be employed to permit adjustment of the height of cover 10 relative to chair "C". In connection with this additional feature, upper pocket 20 of cover 10 includes a front panel 25, a rear panel 26 and a flap 27 which is connected to lower pocket 22 and which is adapted to be folded over the top of seat back 4 and laid against rear panel 26 to form a natural height adjustment mechanism for cover 10. Flap 27 may be held in place against rear panel 26 by any suitable means, such as the hook and loop fastener strips 24, 28 attached to flaps 27 and 26, respectively.

It is to be appreciated that the adjustability feature embodied in flap 27 and fasteners 24, 28 constitutes an option which is not necessary for the realization of the benefits of the instant invention, which is simply a non-woven, form fitting chair cover.

FIGS. 4 and 5 show an additional adjustment feature which may or may not be employed with the instant invention. This additional feature is comprised of a tear away strip 40 attached to lower pocket 22 by a perforated or other frangible connection. Strip 40 may be removed from cover 10 in the event that the legs 6, 8 are shorter than the height of lower pocket 22. In this way, cover 10 will hang down to the bottom of legs 6, 8 and not be too long and cause the material of cover 10 to buckle, which would be a potential tripping hazard as well as unsightly.

Figure 6:
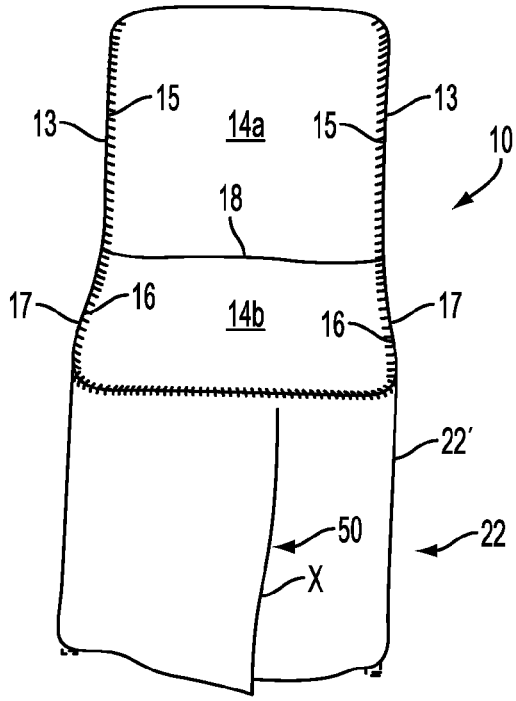
FIG. 6 is a front elevational view of the first embodiment of the instant invention placed over a banquet chair.
Figure 7:
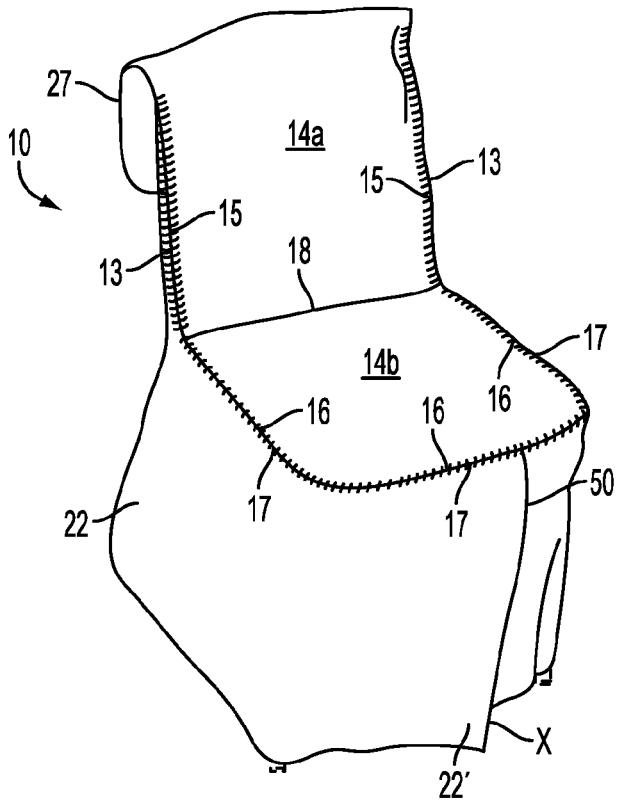
FIG. 7 is a front perspective view of the chair and cover shown in FIG. 6.
Figure 8:
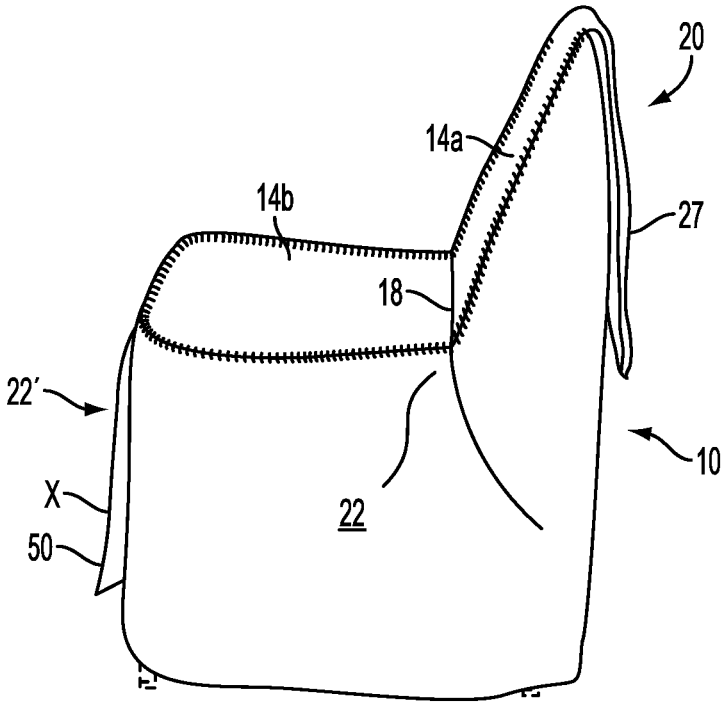
FIG. 8 is a right side elevational view of the chair and cover shown in FIGS. 6 and 7.
Figure 9:
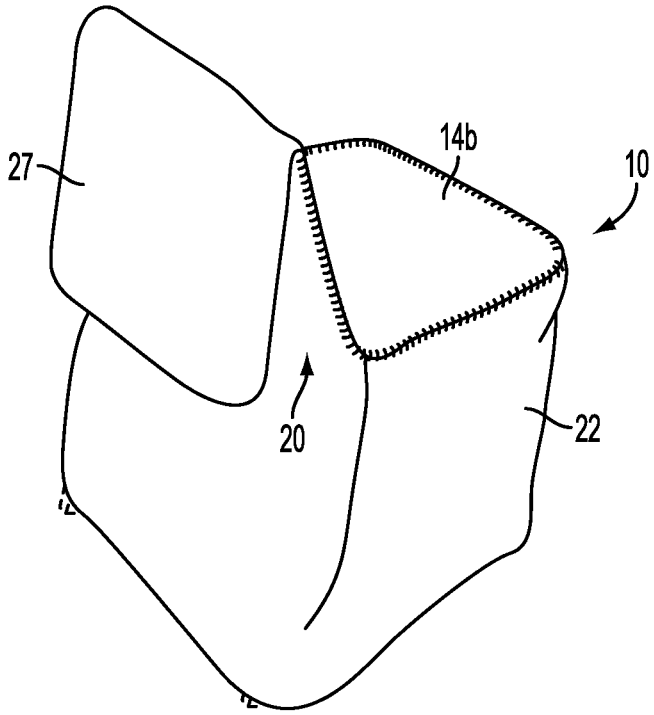
FIG. 9 is a rear perspective view of the assembled chair cover of the first embodiment in its final position about a banquet chair.

Still in the alternative, as best seen in FIGS. 6 and 7, a slit 50 may be provided in the front panel 22' of lower cover section 22. Slit 50 will accommodate a user's feet and legs if the user sitting in the chair attempts to tuck the user's legs up underneath the user. Slit 50 will alleviate undue tensile forces exerted on the material of cover 10 in the event of this occurring. Side edges "x" and "y" form the respective edges of slit 50.

The particular dimensions of cover 10 are not critical to the present invention. Cover 10 may be produced in a variety of different sizes to accommodate chairs of different configurations and dimensions.

Panels 12, 14 of cover 10 may be of a substantially planar material formed from a suitable non-woven fiber material or a composite or laminate thereof, which is widely used in the hygiene products industry. The term "non woven" material fabric refers generally to materials having a structure of individual fibers or threads that are interlaid, not necessarily in a regular, repetitive manner as in a knitted fabric. Non-wovens provide cloth-like aesthetics at a lower cost than typical knitted fabrics. Non-woven fabrics or webs may be formed from many processes such as, for example, meltblowing processes, spunbonding processes, hydroentangling processes, air laid processes, conforming processes, spunbonding/meltblowing/spunbonding processes and bonded carded web processes. These processes are all well known in the hygiene arts and non-woven materials are readily commercially available. For example, non-woven laminates have been available commercially for years from Kimberly Clark Corporation.

Cover 10 may be substantially liquid impermeable, or may be liquid-permeable, depending upon the application to which the cover will be put. Alternatively, cover 10 may be made from a material that exhibits elastic properties, as such materials are known in the art. For example, U.S. Pat. No. 6,207,237 to Haffner discloses an elastic non-woven web or film manufactured from a thermo-plastic polymer. U.S. Pat. No. 6,096,668 discloses an elastic liquid impermeable laminate. U.S. Pat. No. 6,001,460 discloses a laminate material formed of an elastomeric polymer sheet and a non-woven fabric sheet. Other suitable elastic sheet materials are known to those skilled in the art.

Figure 10:
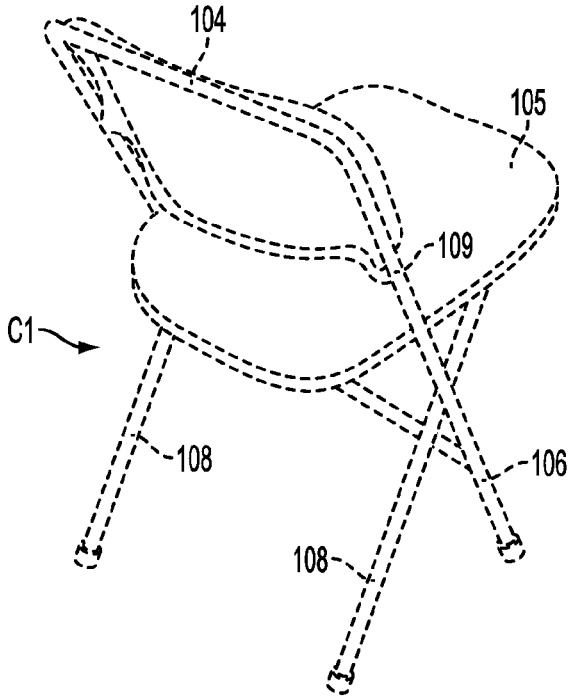
FIG. 10 shows a typical prior art folding chair which a second embodiment of the cover of the instant invention is meant to partially encapsulate.

FIG. 10 shows a conventional folding-type chair denoted by the letter "C1" of the type commonly used at social functions such as weddings, birthday parties, concerts, etc.

Figure 11:
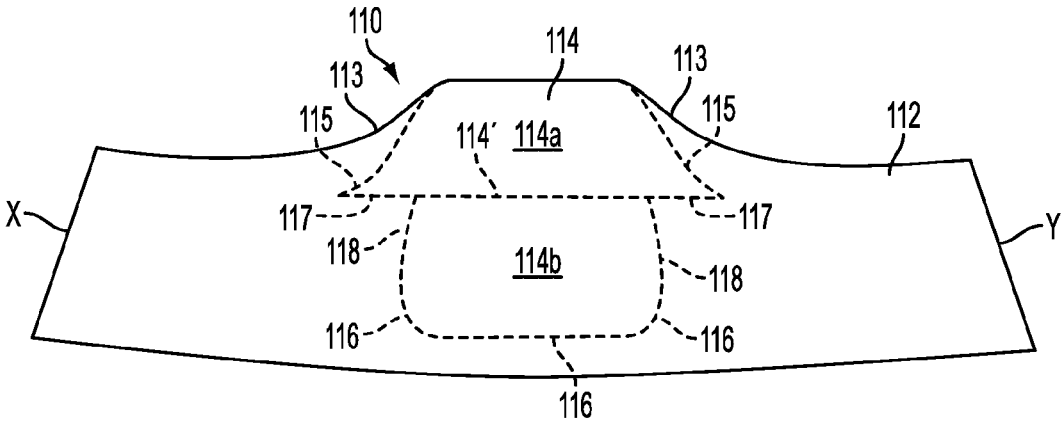
FIG. 11 is a front perspective view of two sections of non-woven fabric which are adapted to be sewn together or otherwise attached to form the second embodiment of the instant invention.
Figure 12:
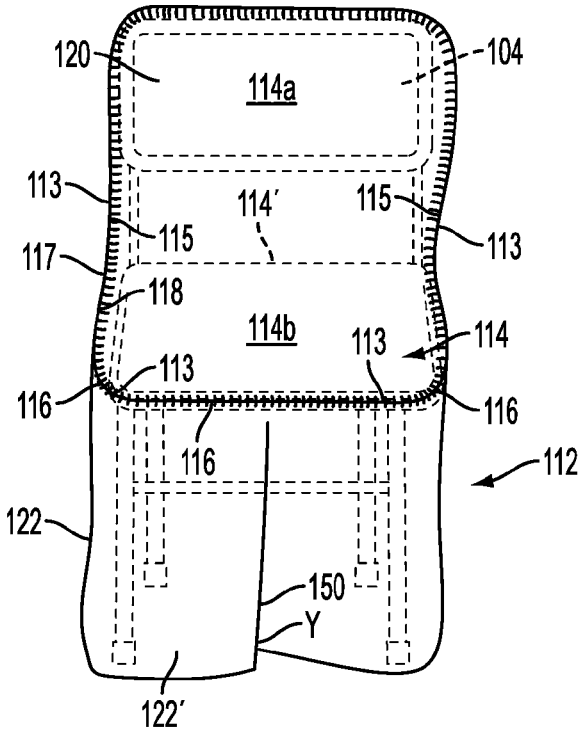
FIG. 12 is a front elevational view of the cover of the second embodiment of the invention in place about a folding chair.
Figure 13:
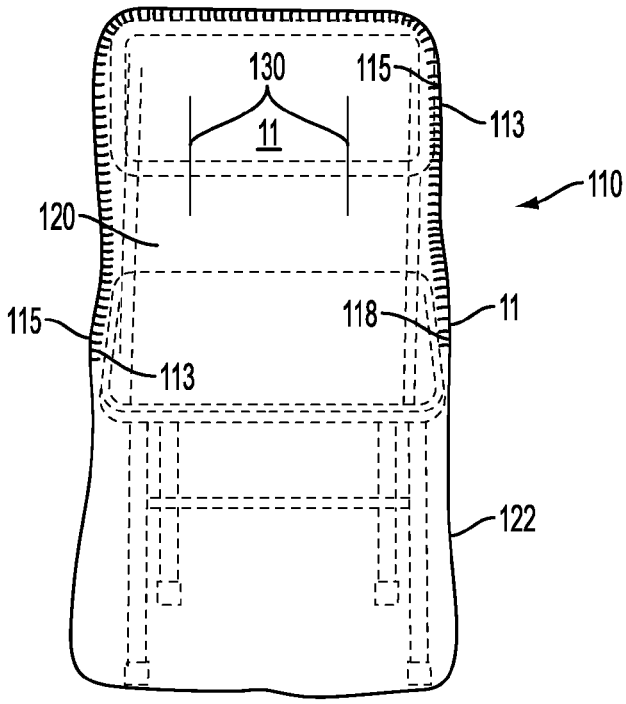
FIG. 13 is a rear elevational view of the cover of the second embodiment of this invention placed about a folding chair.

FIG. 11 shows a typical pattern layout for a second embodiment of the non-woven fabric chair cover 110 of the instant invention adapted to be used to cover the folding-type chair shown in FIG. 10. The pattern layout for the cover 110 is shown in FIG. 11 prior to panels 112, 114 being sewn or otherwise attached together to form a form-fitting chair cover 110. The material may be formed of two panels 112, 114 which are to be sewn together in such a way as to form the cover shown in FIGS. 12 through 16. Sub-panel 112 attaches along an upper edge thereof to an upper edge of sub-panel 114. Also, sub-panel 114 is folded along line 114, so that the upper part of 114*a* of sub-panel 114 lies in registry with front facing surface of seat back 104, and the lower portion 114*b* of sub-panel 114 lies in registry with seat 105. Also, edges 113 of sub-panel 112 are connected to edges 115 of the upper portion of sub-panel 114*a*, edges 117 are connected to edges 118 of the lower portion of sub-panel 114*b*, and the remainder of edges 113 of sub-panel 112 are attached to the edges 116 of lower portion 114*b* of sub-panel 114. Thereafter, edges X, Y of sub-panel 112 may be connected together to form the seat cover shown in FIGS. 12-16, or left unattached to form a slit opening 150. The panels 112, 114 may be attached through sewing/stitching, ultrasonic welding, adhesive, hook and loop fastener, snaps, buttons, or any other suitable connection structure. The cover 110, as seen in FIGS. 13 through 16, forms generally an upper pocket 120 adapted to at least partially envelope seat back section 104, as well as a lower pocket 122 adapted to envelope seat portion 105 and front and rear legs 106, 108 of chair "C1". In this way, a user of the chair will not through ordinary use be able to come into contact with chair "C1" while cover 110 is in place.

FIGS. 12 through 16 show the chair cover after being assembled.

In front panel 122' of lower pocket 122, a slit 150 is employed as in the first embodiment to permit a user seated in the chair to tuck his or her legs up underneath the chair without tearing the cover 110.

Figure 14:
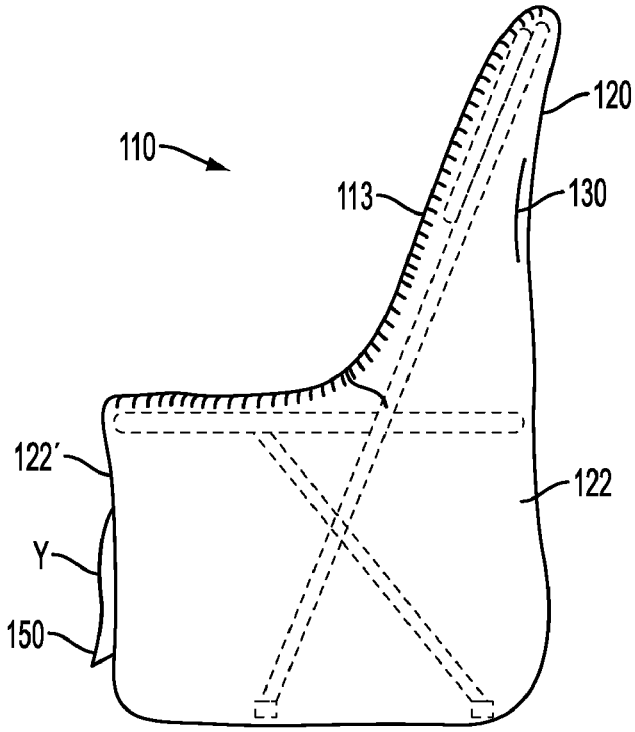
FIG. 14 is a side elevational view of the cover of the second embodiment of this invention placed about a folding chair.
Figure 15:
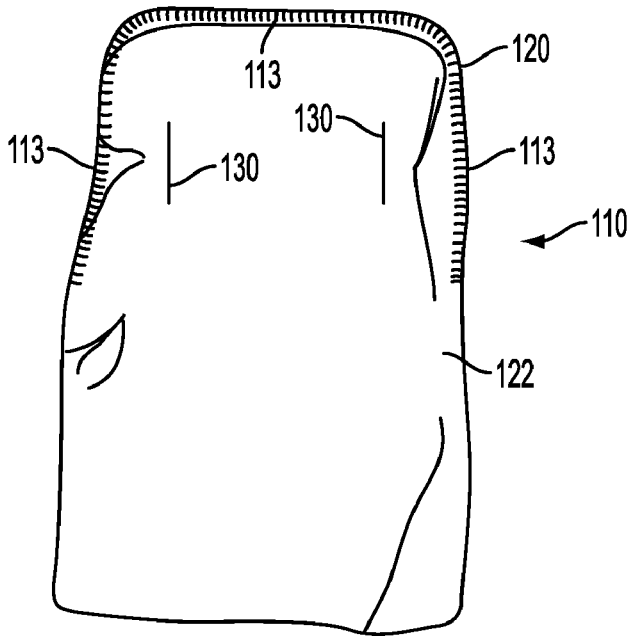
FIG. 15 is a rear elevational view of the cover of the second embodiment of this invention in place about a folding chair, without showing the folding chair in phantom.
Figure 16:
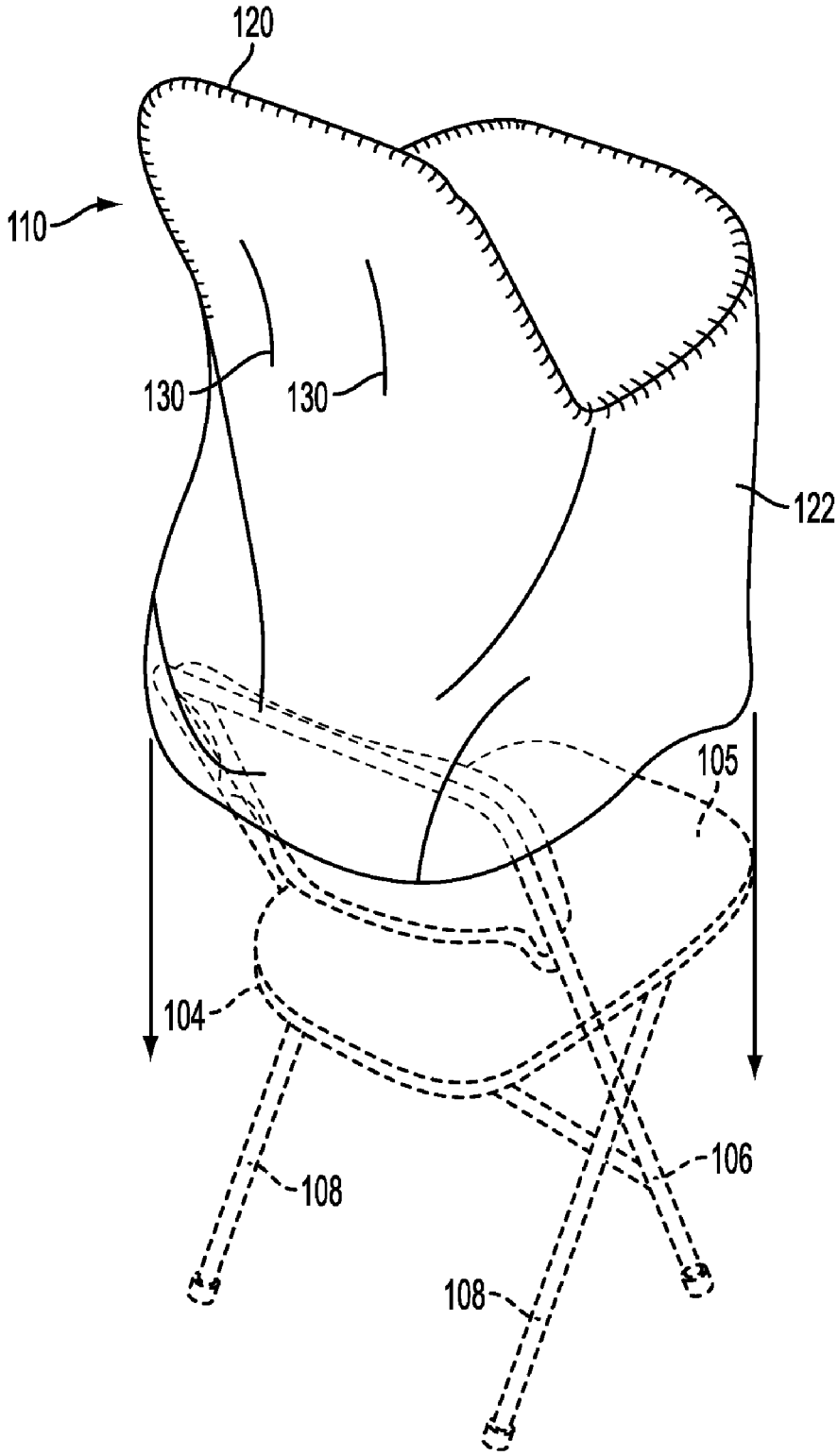
FIG. 16 is a rear perspective view of the cover of the second embodiment of this invention being placed about a folding chair.

As best seen in FIGS. 14 through 16, one or more pleats 130 or "tucks" may be employed to permit a certain amount of "give" in the upper pocket 120 so as to allow upper pocket 120 to fit snugly about the chair back 104.

It can be seen, therefore, that covers 10 and 110 of the first and second embodiments of my invention in the form of cover 110 fit easily and snugly about a standard folding-type chair to provide a protection cover for the chair as well as a beautiful ornamentation for an otherwise bland seating apparatus.

Referring now to FIGS. 17-25, in which like reference numerals designate like items, two modes of practicing the table cover and skirt embodiments of the present invention are disclosed. It is to be understood, however, that departures may be made in the specific structural assembly and use of the invention without departing from the spirit and scope of the invention.

Figure 17:
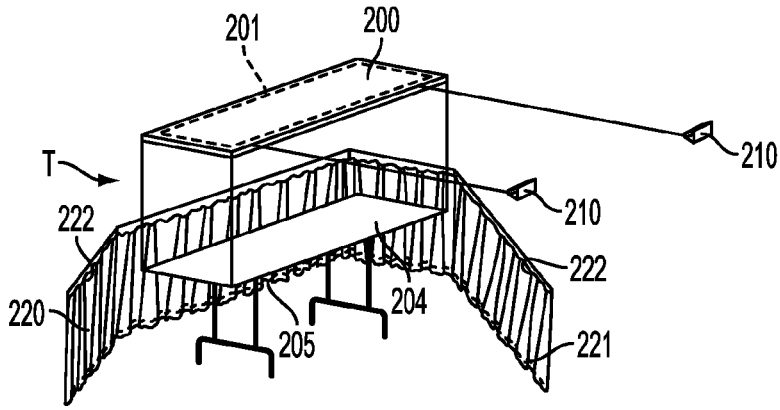
FIG. 17 shows an exploded perspective view of a banquet table, table cover, table skirt, and clips.
Figure 18:
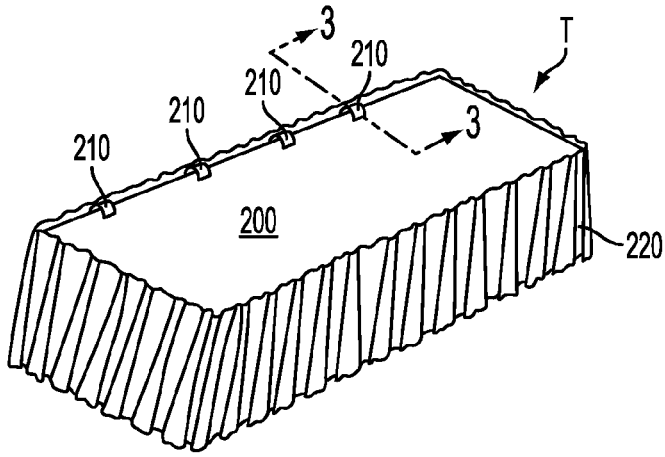
FIG. 18 is a perspective view of FIG. 1, in an assembled state.
Figure 19:
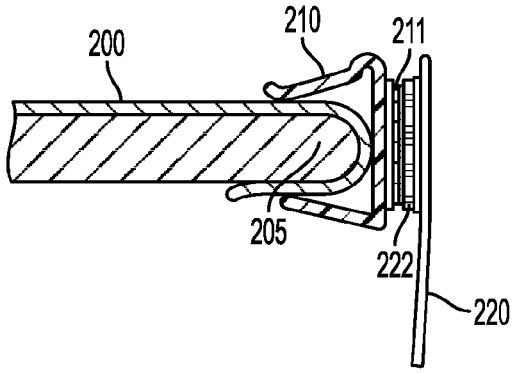
FIG. 19 is an enlarged elevational view of section line 3-3 of FIG. 17.
Figure 22:
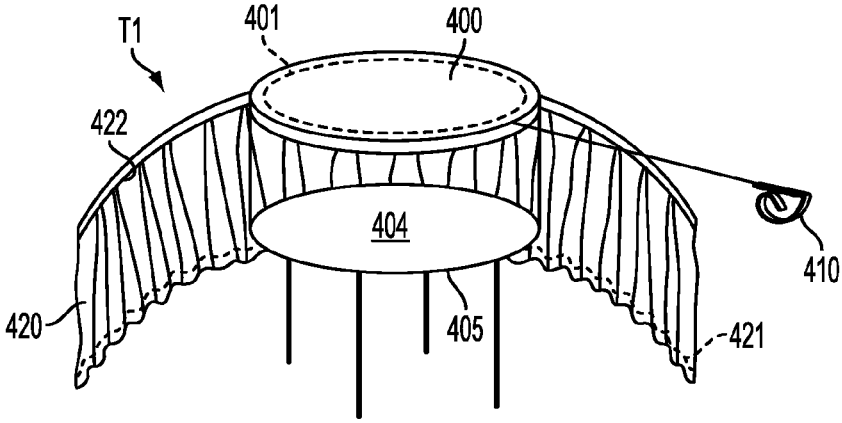
FIG. 22 shows an exploded perspective view of a round table, table cover, table skirt and clips.
Figure 23:
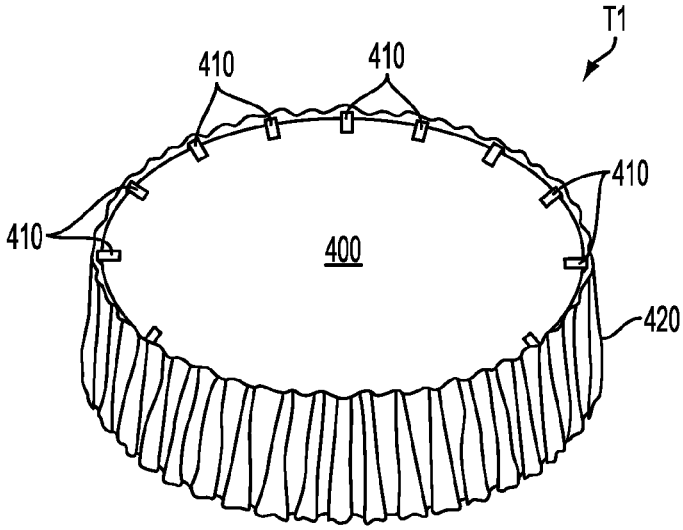
FIG. 23 is a perspective view of FIG. 22 in an assembled state.

As depicted in FIGS. 17-19, 22 and 23, the table cover 200, 400 is placed on the table T, T1 so as to substantially cover the top of the table and, in so doing, to act as a table-cloth. FIGS. 17-19 depict a rectangular table T which is covered by a rectangular table cover 200. FIGS. 22 and 23 provide a round table T1 which is covered by a round table cover 400.

If necessary, because tables are created in a variety of sizes, the table cover 200, 400 may be made of one or more sheets of non-woven fabric which are to be joined together by sewing/stitching, ultrasonic welding, adhesive, hook and loop fastener, adhesive tapes, snaps, buttons, or any other suitable connection structure. In addition, and again because tables are created in a variety of sizes, table cover 200, 400 may optionally include a size reduction feature 201, 401 such as dashed or solid lines defining the terminal edges of a particular size cover or, alternatively, perforations or other easily-removable connection along which excess cover material may be removed. The size reduction feature 201, 401 is visible in FIGS. 17 and 22 for demonstration purposes only. Preferably, the size reduction feature 201, 401 is only visible on one side of the table cover 200, 400 so that it does not affect the overall appearance of the final product.

It will be appreciated that the size enlargement and size reduction features of the table cover 200, 400 are not mutually exclusive. For example, a table may require two rectangular table covers 200 to cover a large table top, but may also need to utilize one of the size reduction features along one length of the table.

Figure 20:
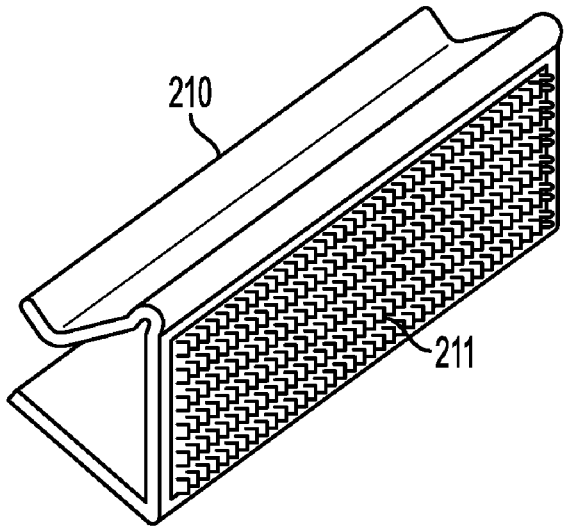
FIG. 20 is a perspective view of the banquet clip.
Figure 21:
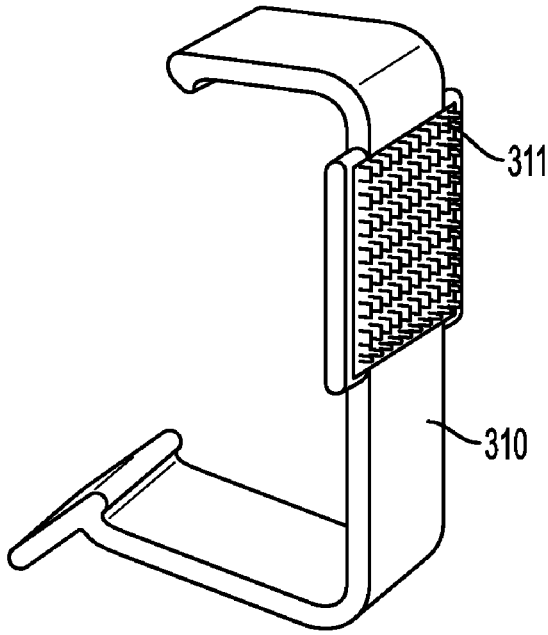
FIG. 21 is a perspective view of the clip utilized with a brand of polyethylene tables manufactured by Lifetime Products, Inc.
Figure 24:
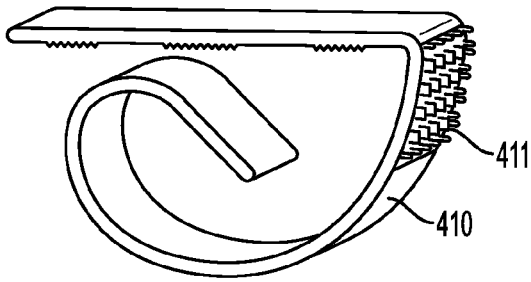
FIG. 24 is a perspective view of an adjustable clip.

The clips 210, 310, 410, shown independently in FIGS. 20, 21 and 24, are then placed over the edge of the table 205, 405 to removably secure the table cover 200, 400 to the table top 204, 404. The clips 210, 310, 410 may include attachment material 211, 311, 411 with which to removably attach the skirt 220, 420 along the edge of the table 205, 405. As depicted in FIGS. 19-21 and 24, the attachment material 211, 311, 411 may comprise hook and loop fastener. However, any suitable attachment material 211, 311, 411 such as hook and loop fasteners, adhesive tapes, snaps, and buttons may be practiced in the present invention.

In addition, and again because tables are created in a variety of sizes, table skirt 220, 420 may optionally include a size reduction feature 221, 421 such as dashed or solid lines defining the terminal edges of a particular size skirt or, alternatively, perforations or other easily-removable connection along which excess skirt material may be removed. Preferably, and as depicted in FIGS. 17, 18, 22 and 23, the size reduction feature 221, 421 is only visible on the side of the skirt 220, 420 facing the table T, T1.

The skirt 220, 420 may also be provided with one or more lengths of attachment material 222, 422. Similar to the attachment material 211, 311, 411 of the clips, 210, 310, 410, the attachment material 222, 422 of the skirt 220, 420 can include hook and loop fasteners, adhesive tapes, snaps, buttons, or any other suitable attachment material. As depicted in FIGS. 17 and 22, the attachment material 222, 422 is provided in a continuous strip. One of ordinary skill in the art would recognize that the attachment material 222, 422 may also be provided in intermittent lengths without departing from the scope of the present invention. To complete the table display, the attachment material 222, 422 of the skirt 220, 420 is attached to the attachment material 211, 311, 411 of the clip 210, 310, 410. The resulting table T, T1 is suitable for any event.

In an alternate embodiment, it may be desirable to attach the skirt 220,420 to the table or other objects by means other than a clip 210, 310, 410. For example, in creating a room of one theme, it may be necessary to place a skirt 220, 420 around a wooden stage, a portable or stationary bar, countertop, table or fixed structure (not shown). In that case, a supply of attachment material (not shown), such as hook and loop fastener, may be included with the kit. The caterer could simply attach the attachment material directly to the edge of the object and then removably attach the corresponding attachment material 222, 422 associated with the skirt 220, 420 to the attachment material connected to the edge of the object. In another example, the hostess may wish to display a beautiful table top without a table cover 200, 400. In that embodiment, the skirt 220, 420 can be attached directly to the table by attachment material (not shown) without the clip 210, 310, 410. Some non-limiting examples of suitable attachment material include hook and loop fasteners, adhesive tapes, snaps, and buttons.

Figure 25:
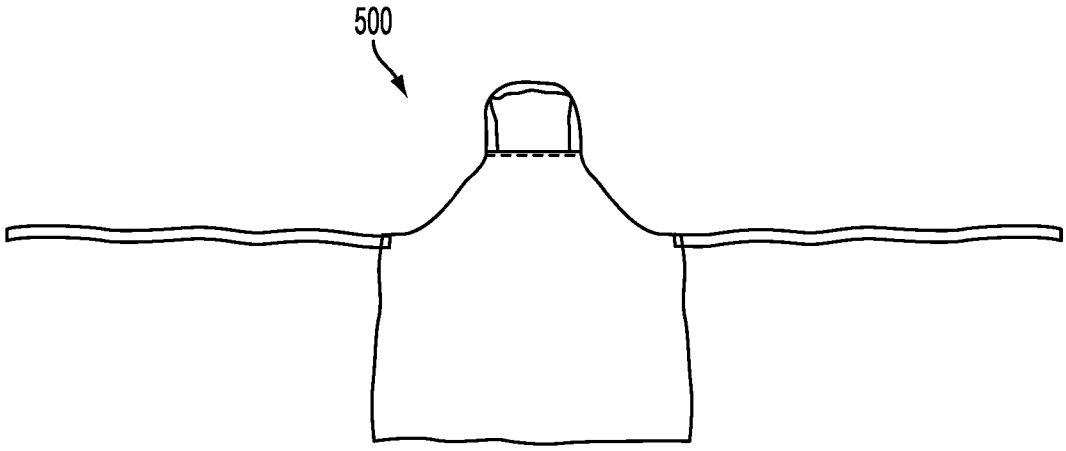
FIG. 25 provides a perspective view of one embodiment of an apron in accordance with the present invention.
Figure 26:
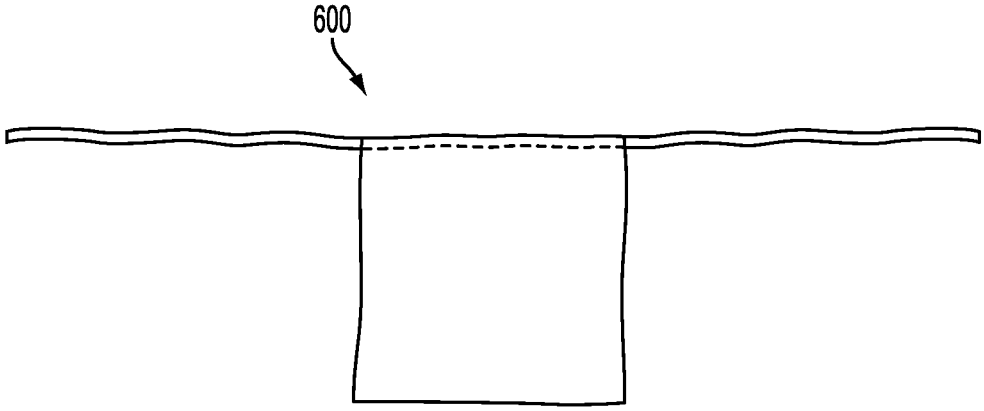
FIG. 26 provides a perspective view of a second embodiment of an apron in accordance with the present invention.

To add to the visual appeal provided by the uniform display of the tables and chairs, the kit may also include one or more aprons 500, 600 made of the same non-woven material as depicted in FIGS. 25 and 26.

Preferably, a kit according to the present invention will include one or more adjustable table covers, one or more adjustable skirts, a plurality of clips, and one or more aprons. However, the inventor recognizes that each caterer's needs are distinct and may also provide the kit components in individual packaging. For example, a caterer may have a chosen color scheme for his/her display and may wish to pair a blue adjustable skirt with a white table cover. The caterer would be able to purchase either the white table cover or the blue skirt separately. In addition, the caterer may be working an outdoor event and require additional clips to add holding strength to the cover and/or skirt due to the weather.

A kit of the present invention may only include the table top and/or the table skirt and/or clips and/or any combination thereof. The components of the kit will be dictated by the needs of the consumer.

In addition, the present invention is not limited to use by caterers. Kits to be used at home could include birthday-themed table covers and skirts or even in simple decorative patterns for normal day-to-day decoration. This invention is perfect for the person who likes to frequently alter the appearance of their rooms because it is low-cost and disposable. Therefore, a person could alter the appearance of a room every week, if desired.

Figure 27:
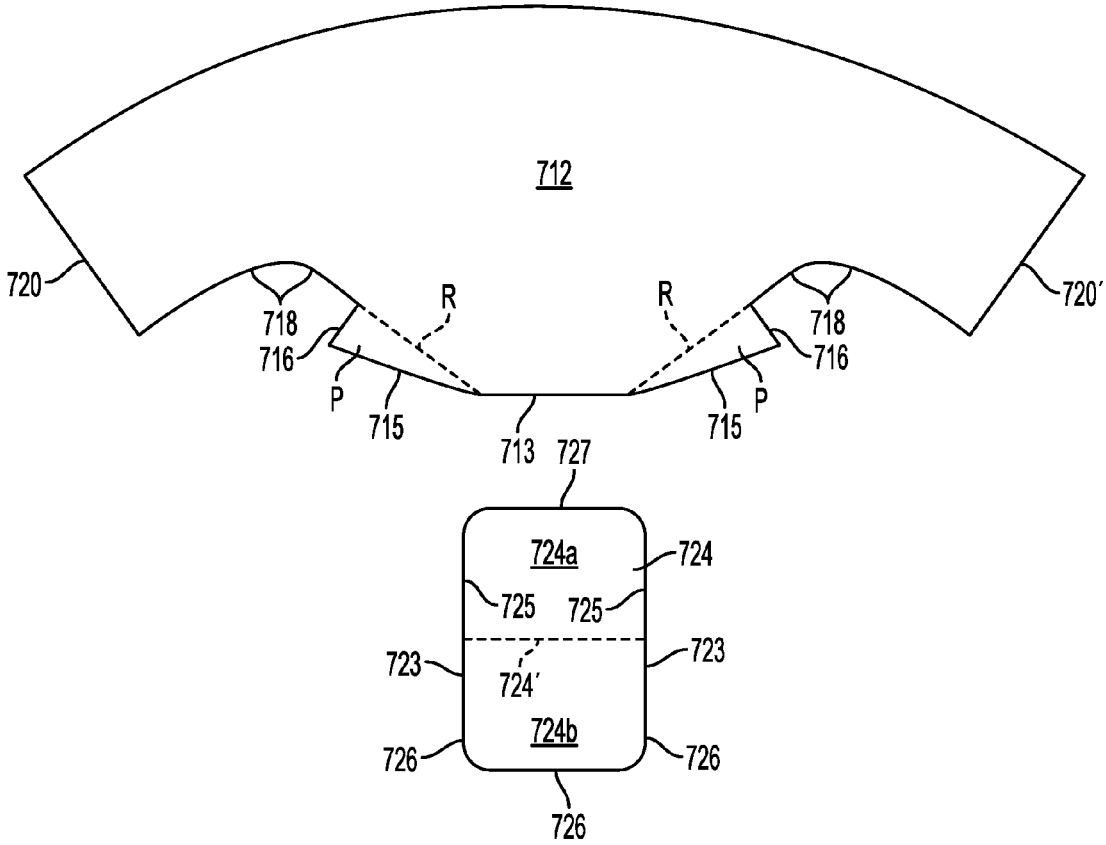
FIG. 27 is top plan view of two sections of non-woven fabric which are adapted to be sewn together or otherwise attached to foam the third embodiment of the instant invention.
Figure 28:
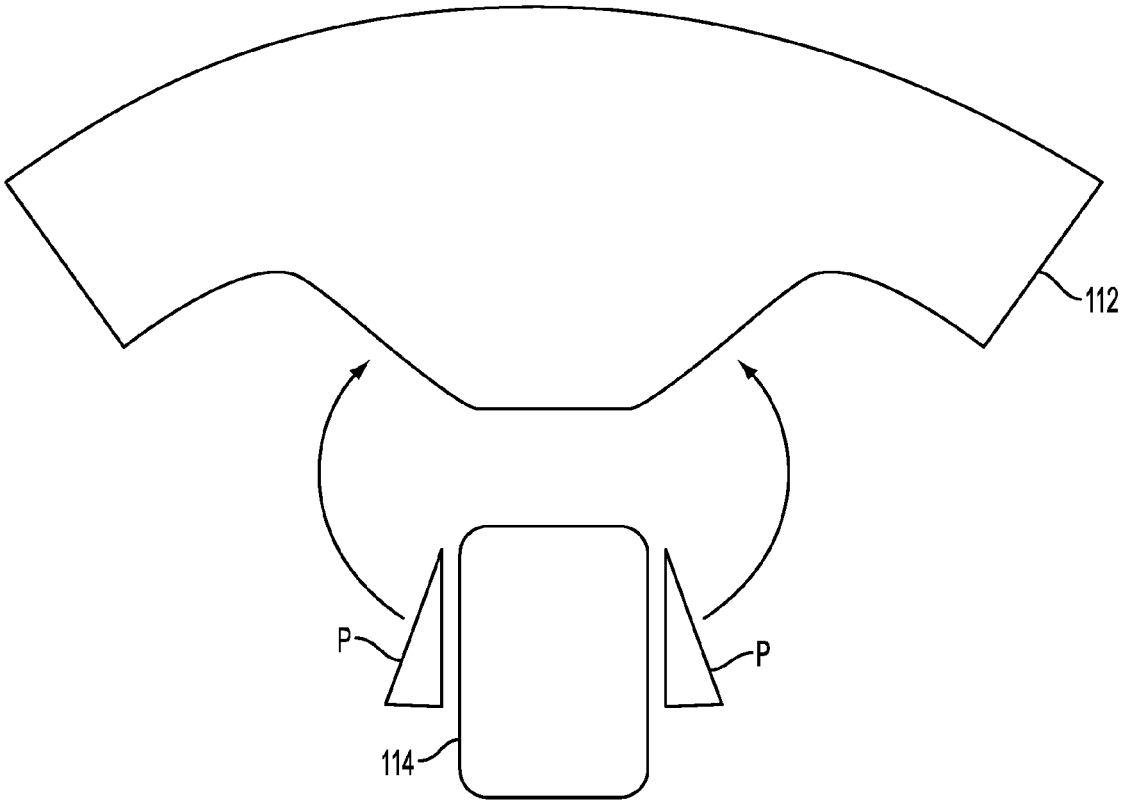
FIG. 28 is a diagrammatic representation of the modification made to the two sections of non-woven fabric of FIG. 11 which I have invented and which results in the third embodiment fabric patterns shown in FIG. 27.

FIGS. 27-30 show a modified pattern layout for the second embodiment of the non-woven fabric chair cover 710 of the instant invention adapted to be used to cover the folding-type chair shown in FIG. 11. The pattern layout for the cover 710 is shown in FIG. 27. FIG. 28 shows how the pattern layout of chair cover 110 has been modified from that shown in FIG. 11. The novel modification to cover 110 which results in the configuration of the pattern layout comprising cover 710 includes moving triangular sub-panels P from sub-panel 114 to sub-panel 112. This is most easily accomplished by providing said triangular shaped panels P as an integral part of sub-panel 712 when cutting sub-panel 712 from a sheet or bolt of fabric. Doing so results in substantial savings on the amount of fabric used to create chair covers 710, as to have created sub-panel 724 with triangular sub-panels P integrally formed therewith requires more raw fabric than cutting sub-panel 712 as shown in FIG. 27, thereby saving raw material costs. The transition is represented by dotted lines R in FIG. 27.

Figure 29:
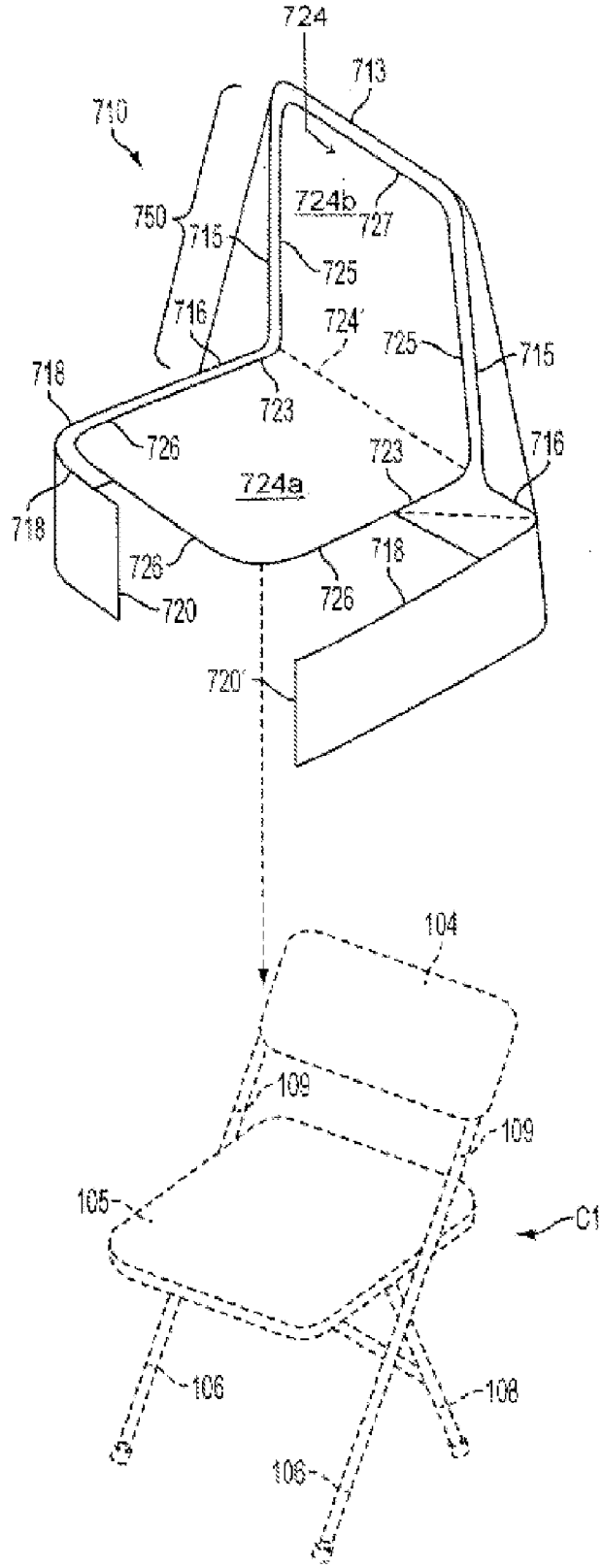
FIG. 29 is a left front perspective view of the two sections of fabric shown in FIG. 27 during assembly.
Figure 30:
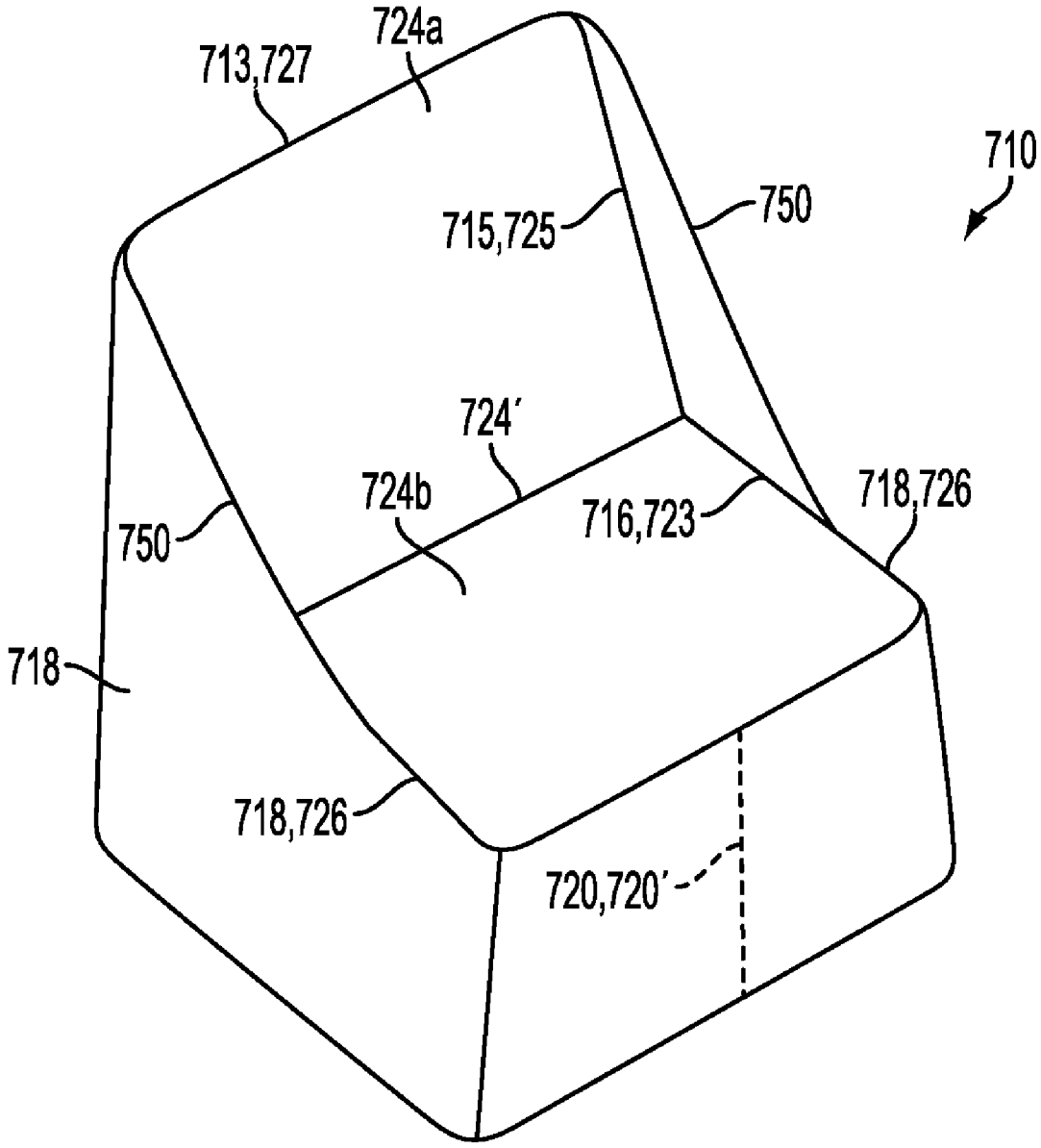
FIG. 30 is a right front perspective view of the third embodiment chair cover of this invention placed over a folding chair.

FIG. 29 shows cover 710 in a partially assembled state. FIG. 30 shows cover 710 sewn together and placed over a folding-type chair C1. Thus-formed cover 710 functions similarly to cover 110 described in connection with FIGS. 11-16, and that description is incorporated herein.

Sub-panels 712 and 724 are assembled by attaching upper edge 713 of first sub-sheet section 712 to upper edge 727 of second sub-sheet section 724. Also, first seat back-forming edges 715 of first sub-sheet section 712 are connected to second seat back-forming edges 725 of second sub-sheet section 724, first pocket forming edges 716 of first sub-sheet section 712 connected to second pocket-forming edges 723 of second sub-sheet section 724, and first seat-forming edges 718 of first sub-sheet section 712 connected to second seat-forming edges 726 of second sub-sheet section 724.

As best seen in FIGS. 29 and 30, in order to attach sub-panels 712 and 724 to each other in the manner specified immediately above, sub-panel 712 is folded along fold line 724' at or near a 90° angle. Given that intermediate portions 109 of front legs 106 of folding chair C1 extend somewhat forwardly of seat back 104, it is necessary to make an accommodation in cover 710. In the preferred embodiment, therefore, pockets 750 are formed by the sub-sections of sub-panel 718 bounded by edges 715, 716, 725 and 723 when connected, which form triangular shaped pockets 750, as best seen in FIG. 29. Any of the additional features discussed in connection with a first and second embodiment of the chair covers of this invention may or may not be employed in connection with this third embodiment.

The invention has been shown and described herein in the form of preferred embodiments with alternative features. It is to be understood, however, that the scope of the invention is not limited to these embodiments and additional features disclosed herein, and that the invention is intended to be limited only by the following claims.

What is claimed is:

1. A cover for a folding chair, the chair including legs, a seating portion and a seat back portion, comprising:

a first sub-sheet section;

a second sub-sheet section;

the first sub-sheet section being substantially T-shaped and being bounded at least partially by an upper edge, first seat back-forming edges, first pocket-forming edges, and a first seat-forming edge;

the second sub-sheet section being bounded at least partially by an upper edge, second seat back-forming edges, second pocket-forming edges, and a second seat-forming edge;

the first and second sub-sheet sections being connected by attaching at least a portion of the upper edge of the first sub-sheet section to at least a portion of the upper edge of the second sub-sheet section, connecting at least a portion of the first seat back-forming edge to corresponding portions of the second seat back-forming edge, connecting at least a portion of the first pocket-forming edge of the first sub-sheet section to the second pocket-forming edge of the second sub-sheet section, and connecting at least a portion of the first seat-forming edge of the first sub-sheet section to corresponding portions of the second seat-forming edge.

2. The cover of claim 1, wherein the first sub-sheet section is comprised of polymeric non-woven fabric.

3. The cover of claim 1, wherein the second sub-sheet section is comprised of polymeric non-woven fabric.

4. The cover of claim 1, wherein the first and second sub-sheet sections are comprised of polymeric non-woven fabric.

5. The cover of claim 1, wherein the second sub-sheet section is substantially rectangularly shaped and comprises a seat-back covering panel adapted to lie substantially in registry with at least a portion of the seat back portion, and a seating portion covering panel adapted to lie substantially in registry with at least a portion of the seating portion of the chair.

6. The cover of claim 1, wherein said second sub-sheet section includes a fold line between the seat-back covering panel and the seating portion covering panel.

7. The cover of claim 1, wherein the first and second sub-sheet sections are comprised of non-woven fabric manufactured from one of the processes of melt-blowing, spun bonding, spun bonding/melt-blowing, or bonded carded web.

8. A cover for a folding chair, the chair including legs, a seating portion, a seat back portion, wherein first and second front legs of the chair extend upwardly from a floor at an oblique angle to the floor and connect to the seat back portion, a portion of each of the first and second front legs lying adjacent the seating portion of the chair and above a plane in which a substantial portion of the seating portion of the chair resides being referred to as the first and second intermediate leg sections, comprising, a first sub-sheet section;

a second sub-sheet section;

the first sub-sheet section being shaped substantially T-shaped and being bounded at least partially by an upper edge, first seat back-forming edges, first pocket-forming edges, and a first seat-forming edge;

the second sub-sheet section being bounded at least partially by an upper edge, second seat back-forming edges, second pocket-forming edges, and a second seat-forming edge;

the first and second sub-sheet sections being connected by connecting at least a portion of the upper edge of the first sub-sheet section to at least a portion of the upper edge of the second sub-sheet section, connecting at least a portion of the first seat back-forming edge to corresponding portions of the second seat back-forming edge, connecting at least a portion of the first pocket-forming edge of the first sub-sheet section to the second pocket-forming edge of the second sub-sheet section, and connecting at least a portion of the first seat-forming edge of the first sub-sheet section to corresponding portions of the second seat-forming edge; and first and second portions of the first sub-sheet section forming first and second pockets which partially encapsulate the first and second intermediate leg sections.

9. The cover of claim 8, wherein the first sub-sheet section is comprised of polymeric non-woven fabric.

10. The cover of claim 8, wherein the second sub-sheet section is comprised of polymeric non-woven fabric.

11. The cover of claim 8, wherein the first and second sub-sheet sections are comprised of polymeric non-woven fabric.

12. The cover of claim 8, wherein the second sub-sheet section is substantially rectangularly shaped and comprises a seat-back covering panel adapted to lie substantially in registry with at least a portion of the seat back portion, and a seating portion covering panel adapted to lie substantially in registry with at least a portion of the seating portion of the chair.

13. The cover of claim 8, wherein said second sub-sheet section includes a fold line between the seat-back covering panel and the seating portion covering panel.

14. The cover of claim 8, wherein the first and second sub-sheet sections are comprised of non-woven fabric manufactured from one of the processes of melt-blowing, spun bonding, spun bonding/melt-blowing, or bonded carded web.

* * * * *